US005655939A

United States Patent [19]

Garrido Salvadores

[11] Patent Number: 5,655,939

[45] Date of Patent: Aug. 12, 1997

[54] TOWABLE BOARD FOR UNDERWATER SWIMMING AND RIDING ON THE WATER SURFACE

[76] Inventor: Fernando Garrido Salvadores, Agastia, 74 DPDO)., Madrid, Spain, 28043

[21] Appl. No.: 524,184

[22] Filed: Sep. 6, 1995

Related U.S. Application Data

[63] Continuation of Ser. No. 225,721, filed as PCT/ES93/00044, May 25, 1993, published as WO93/24185, Dec. 9, 1993, abandoned.

[30] Foreign Application Priority Data

May 29, 1992 [ES] Spain ..... P9201104

[51] Int. Cl.[6] ..... B63B 35/79

[52] U.S. Cl. ..... 441/65; 114/244; 114/253

[58] Field of Search ..... 114/253, 254, 114/315, 244; 441/65, 79; D21/228

[56] References Cited

U.S. PATENT DOCUMENTS

| | | | |
|---|---|---|---|
| D. 255,820 | 7/1980 | Borden et al. | 441/65 X |
| 1,918,508 | 7/1933 | Wheeler | 441/65 |
| 2,709,266 | 5/1955 | Munn | 114/315 X |
| 4,149,483 | 4/1979 | Scott, Jr. | 114/332 |
| 4,207,829 | 6/1980 | Meister et al. | 114/245 |
| 4,973,279 | 11/1990 | Baumann | 441/65 X |
| 5,080,620 | 1/1992 | Reden | 114/253 X |

FOREIGN PATENT DOCUMENTS

| | | |
|---|---|---|
| 2 635 307 | 8/1988 | France . |
| 2 210 170 | 7/1994 | France . |

*Primary Examiner*—Sherman Basinger
*Attorney, Agent, or Firm*—Darby & Darby

[57] ABSTRACT

The rudder is comprised of a planar body wherein a large front notch and a rear notch form two lobes or side wings which are perfectly symmetric with respect to the front-to-rear axis. On the axis and at the vicinity of the front notch is provided the unique point of towing, variable through a movable part, to which is fixed the corresponding towing rope. On each side wing, there are arranged, symmetrically and forward of the towing point, two windows that the user can grip with his or her hands and, behind the windows, in the lower part of the device and also in a symmetrical arrangement there are provided two rudder-like fins. The apparatus can be gripped manually with the arms extended forward allowing a swimmer-diver to move on the water or in the water.

24 Claims, 4 Drawing Sheets

TOWABLE BOARD FOR UNDERWATER SWIMMING AND RIDING ON THE WATER SURFACE

This is a continuation of Ser. No. 08/225,721 filed Jan. 13, 1994 and now abandoned, which is a continuation of international application PCT/ES93/00044 filed May 25, 1993 and which has been published as WO93/24185.

OBJECT OF THE INVENTION

The present invention refers to an apparatus that has been conceived and structured in order to allow one to perform a new water sport and that, convenient towed, permits a person to do exercises of riding on the surface of water and of underwater swimming, with the possibility of controlling one's own movements by tilting the apparatus or rudder vertically and transversally as well as in combination, specifically to achieve lateral movement of the body in terms of the imaginary path defined by the tractor vehicle, as well as upward and downward movements in the water.

BACKGROUND OF THE INVENTION

There are a large number of sports and activities performed in water, some are performed on the surface and others under water. Within this broad range of possible groups of sports can be established, one of which is based exclusively on human skill, which includes swimming, waterpolo, apnea diving, etc. A second group adds to the cited human skill the use of floating elements, and in this sense, "paragüismo", sailing, surfing, wind-surfing, etc. can be cited. There is a third group in which aside from the above cited human skill, floating and mechanical elements are combined, such as for example, motorized sailing boards, water-skiing, etc. There is a fourth group in which elements which permit one to stay underwater, such as diving, skin diving with air tanks, etc., are used.

Specifically within the scope of sports that combine floating and mechanical elements, in which the object of the invention fits, the possibilities that these types of sports permit are rather restricted, since specifically in the scope motorized sailing, it is simply a question of driving vehicles on the surface of water, in a way relatively similar to how driving is done on the ground, specifically without the possibilities of immersion, and the same thing is true for water skiing, where the skier can only try to achieve a speed record on water, towed by the corresponding boat.

DESCRIPTION OF THE INVENTION

The combined rudder or towable board that the invention proposes, as it has just been stated, could be placed in the group of sports in which floating and mechanical elements are combined, but offering a considerably higher level of possibilities than the above cited group of sports, in addition to being completely novel possibilities.

In a more specific manner and as it has already been stated, the towable board that is proposed allows for riding on the surface of water, with control of lateral movement similar to that of water skiing, although at a slower speed, and likewise underwater swimming, with the same control of lateral movement and with a parallel control of the level of depth, either with the limitation of having to come up periodically for air, or else without this need upon using air tanks for breathing purposes.

More specifically, the towable board that is proposed is structured from a flat body, made of a suitable light and resistant material, in which two side lobes perfectly symmetric with regard to the antero-posterior or front to rear axis of the body, are defined, in such a way that in correspondence with said axis a broad front notch which provides access to a sole traction point located upon said axis is defined, and a rear structure that permits the device to be placed in front of the swimmer's-diver's head, when he grasps the apparatus with his arms extended, in the normal usage position, without any risk of the flat body hitting his head.

In each one of the two side wings or lobes of the cited flat body, aligned transversally and placed in front of the traction point, two transversal windows suitable formally and dimensionally to permit one to insert one's fingers in order to grip the apparatus in a normal fashion, the rear edge of said windows having the possibility of being shaped anatomically in order to make it easier to grip same.

Finally and as a complement of the described structure, in each one of these two lobes or wings of the sheetlike body, on the bottom surface thereof and preferably behind the cited windows, both fins are established. These fins will preferably adopt an arrangement perpendicular to the flat body, but they can likewise adopt an oblique arrangement, enhancing controllability of the apparatus in any case.

Obviously not only the two lobes or wings of the flat body should be perfectly symmetric to the front to rear axis of the apparatus, but the cited windows and fins also should adopt perfectly symmetric positions, in order to ensure a suitable balance, it being obvious that the larger the distance between the traction point and the transversal line corresponding to the windows defining the hand grips, the greater the maneuverability of the apparatus, but this maneuverability will be more difficult, requiring some better physical conditions and greater mastery, for which reason the existence of different apparatus, suitable to different levels of use, from beginners up to real experts, or optionally the arrangement of a sole apparatus in which the traction point is unrelated to the flat body, has been provided for, being established on a small transversal bridge with adjustable positioning all along the axis of the apparatus, so that each user, in terms of his own possibilities and criteria, will place said bridge in the working position considered most convenient.

DESCRIPTION OF THE DRAWINGS

In order to complete the description that is being made and for the purpose of providing a better understanding of the characteristics of the invention, the present specification is accompanied by a set of drawings, as an integral part thereof, in which the following has been represented in an illustrative and nonrestrictive manner.

PREFERRED EMBODIMENT OF THE INVENTION

Figure 1:
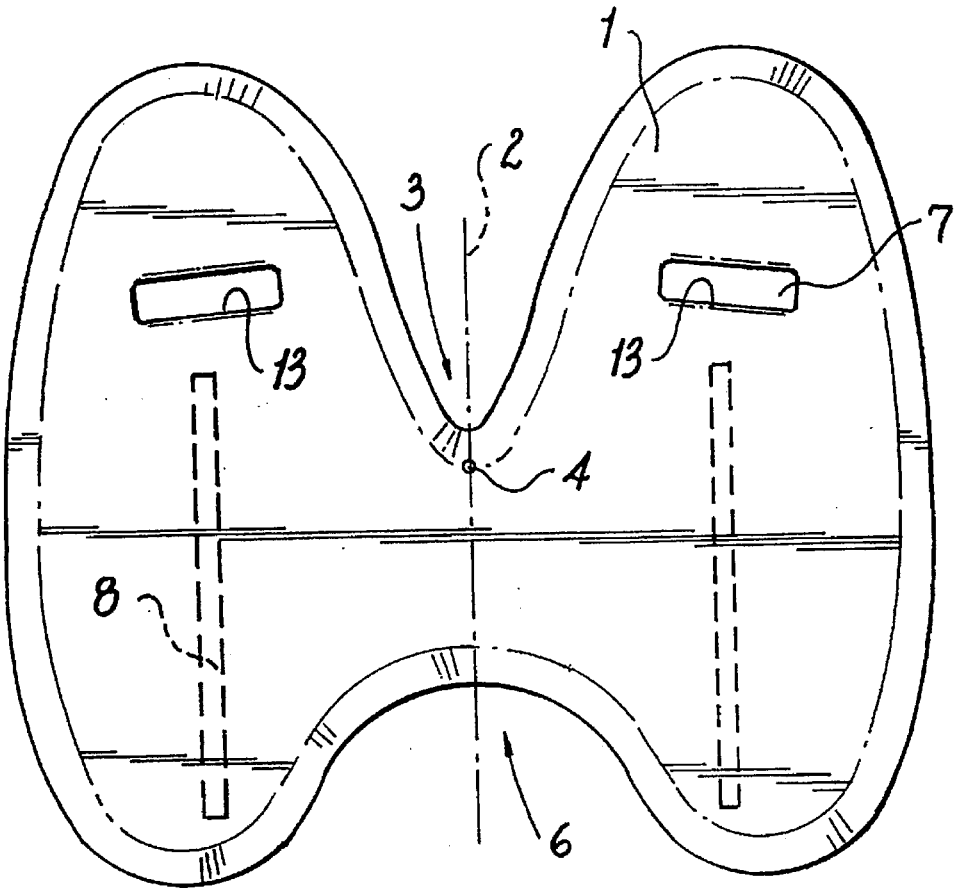
FIG. 1.—It shows a plan view of the towable board for underwater swimming and riding on the surface, made in accordance with the object of the present invention.
Figure 2:
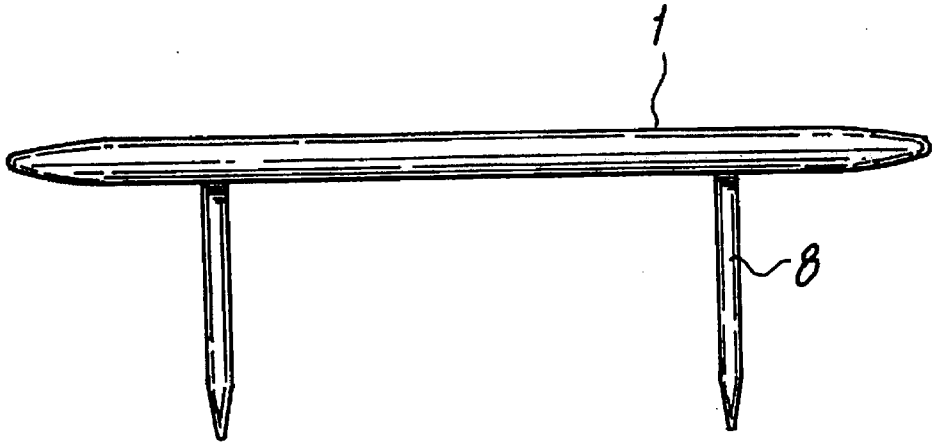
FIG. 2.—It shows a front raised view of the same combined rudder.

In view of these figures it can be seen how the apparatus that is proposed is structured from a considerably flat body (1), which as it has been stated above will be made out of a light and resistant material, such as suitable rigid plastic materials. The apparatus contour adapts to a shape relatively similar to that of a butterfly, with its wings extended. The shape is perfectly symmetric to the imaginary front to rear axis thereof (2) and defines in the same a deep front notch (3), which approaches the traction point of the apparatus, materialized in a simple hole (4), to which the wire towline or towing rope (5) that connects the apparatus with the boat towing the same can be connected. Another broad outer notch (6) is defined by the apparatus which, as is also seen in FIG. 4, enables movement of the user's head, without the risk of hitting his head on the flat body that especially arise during the normal tilting of the arms to maneuver the apparatus.

In each one of the side wings or lobes of this flat body (1) and in the front, a transversal window (7) is established. Window (7), as can also be seen in FIG. 4, constitutes the grips of the apparatus, so that the user will rest his arms on the top surface of the lobes, passing his fingers through these windows.

Figure 3:
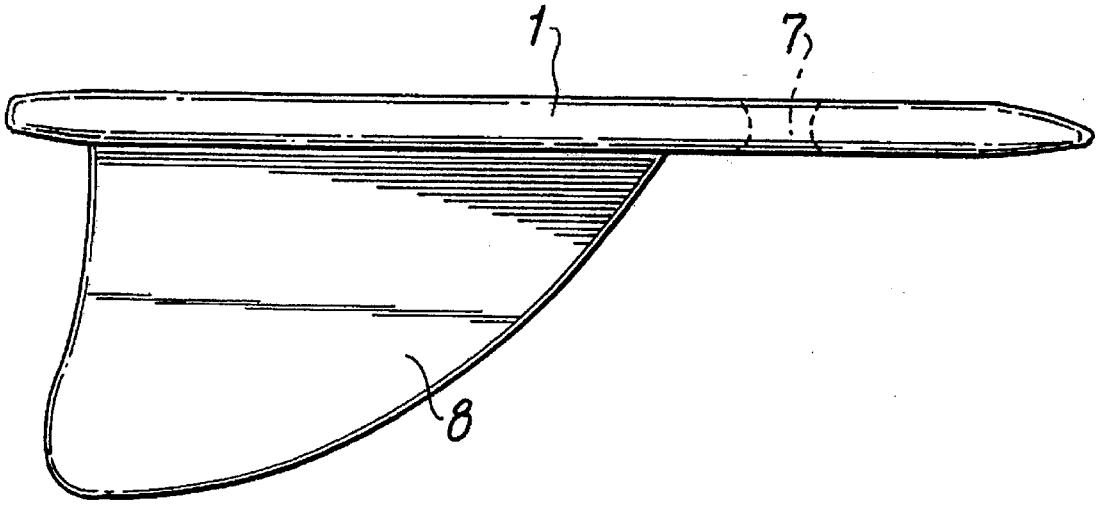
FIG. 3.—It shows a side raised view, in which the windows corresponding to the grips of the apparatus have been represented with a broken line.

Complementary to the bottom surface of the flat body (1) and in each one of its lobes, a longitudinal fin (8), that can have the triangular shape represented in FIG. 3 or any other shape that is considered convenient, is established. Likewise, these fins (8) can be perpendicular to the flat body (1), as seen in FIG. (2), or form any other suitable angle with the flat body, without this affecting the essence of the invention.

Figure 4:
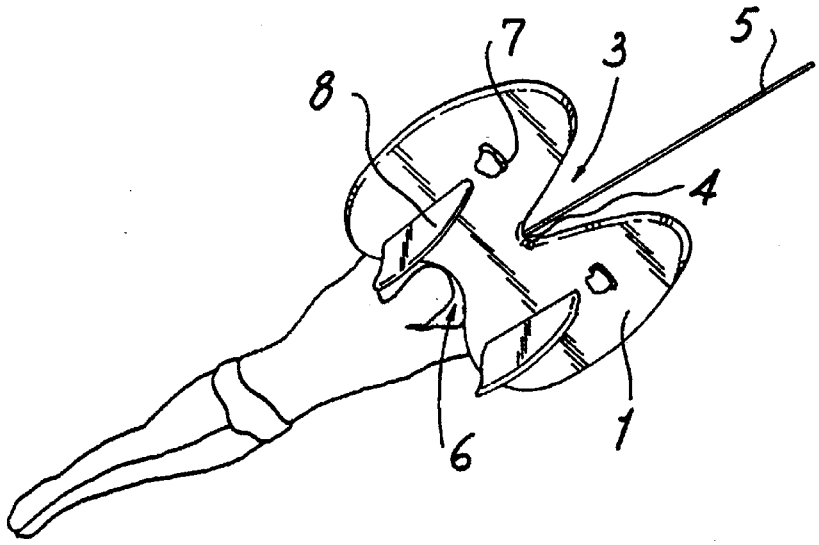
FIG. 4.—According to a schematic and perspective view, it shows an example of practical use of the towable board of the above figures.

The windows (7), that adopt just like the fins (8) positions perfectly symmetric to the front to rear axis (2), will be preferably slanted slightly outward and backward for the purpose of attaining a perfect placement for one's hands, taking into consideration the slightly diverging position that the user's arms must adopt in turn and that also appear represented in the above cited FIG. 4.

As it has already been pointed out above, the distance between the imaginary line that connects the two side windows (7) and the traction point (4) determines the degree of maneuverability of the apparatus, which is greater the greater this distance is, though this requires some better physical conditions and greater experience. Hence, it is implied that while initially, that is to say for beginners, this distance must be minimal, the same must increase progressively with the user's experience. In this sense and in accordance with the representation of FIG. 5, a variant of the embodiment of the apparatus in which the cited front notch (3') is considerably deeper, establishing on both sides of the same both alignments of holes (9) that permit fastening, with the possibility of positional adjustment, for a transversal bridge (10) that is that which includes the traction point (4), has been provided for. The bridge (10) includes at least two holes (12), through which it can be coupled in any suitable position by means of screws or any other suitable fastening devices to two of the holes (9) in the wings of the flat body (1).

Figure 5:
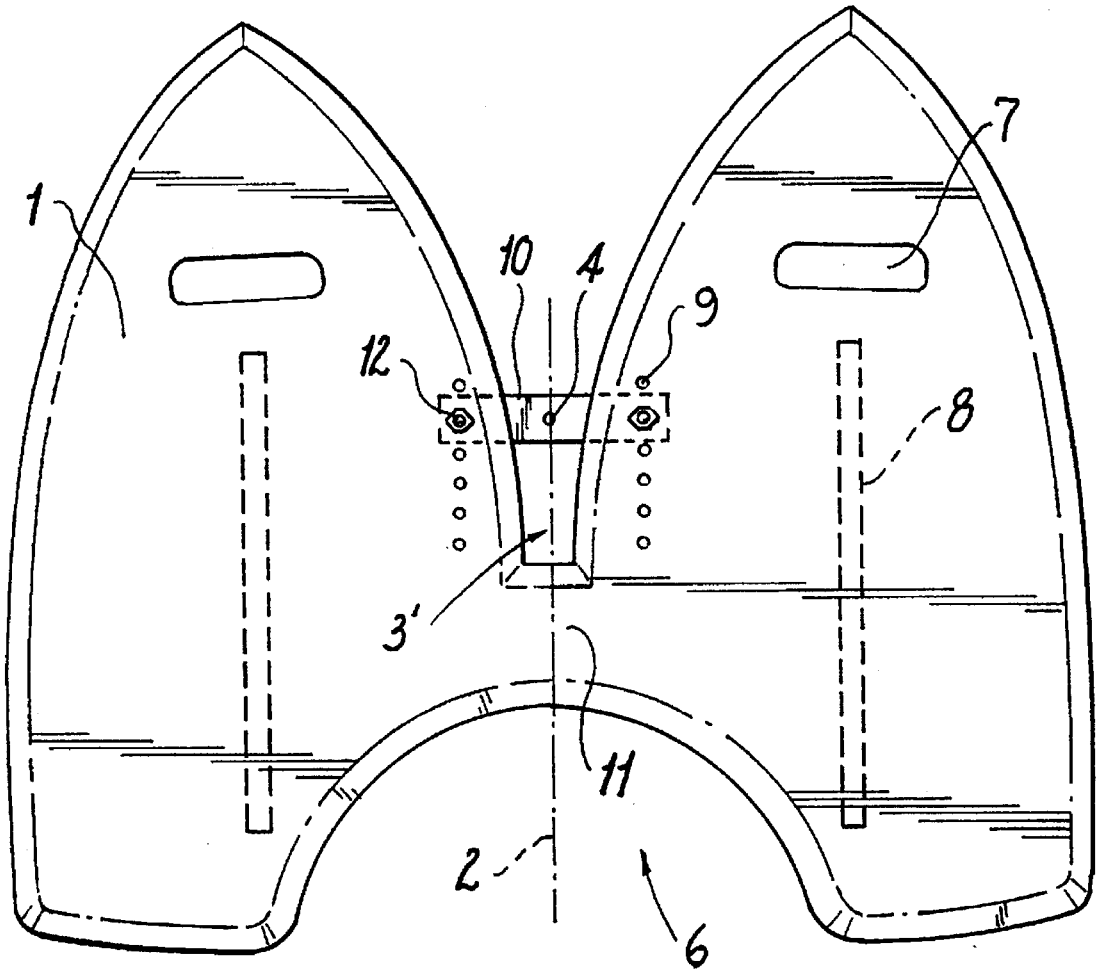
FIG. 5.—Finally, it shows a plan view similar to that of FIG. 1 but corresponding to a towable board with an adjustable traction point.
Figure 6:
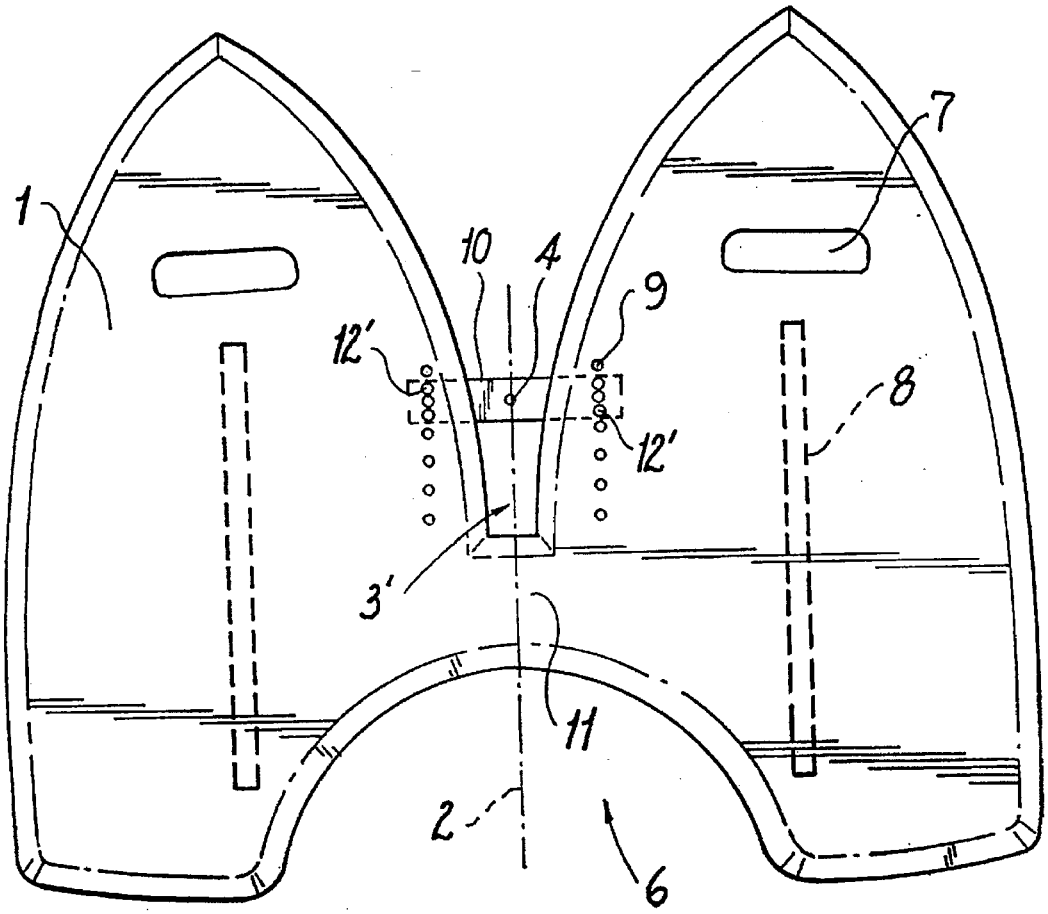
FIG. 6 shows a variation of the embodiments illustrated in FIG. 5.

In a variation of the embodiment corresponding to FIG. 5 and represented schematically in FIG. 6, the bridge (10) is provided with lines of consecutive holes (12') for fastening to at least two holes (9') in the wings of the flat body (1), thereby providing, in an alternative but equivalent way, for the possibility of positional adjustment along the front to rear axis (2).

Furthermore, the portion (11) established between the front notch (3) and the rear notch (6) can be delimited in such a degree that to normal front to rear and side tilting movements for the flat body (1) a relative tilting movement between the side wings or lobes thereof can be added, which obviously permits one to make "spirals" under the water, though obviously this possibility is reserved for real expert sportsmen. The traction point 4 can be connected to a towing rope. The traction point 4 is disposed on the front to rear axis 2. The front notch 3 has a saddle point that is located in a rear position with respect to a transverse line passing through a contact point 12 of a user's hands on the grips 7. The traction point 4 is located between the saddle point and this transverse line. As illustrated, for example, in FIG. 1, the grips 7 each have a forward edge and a rear edge. Contact point 12 is disposed on the rear edge.

In accordance with the above, the user gripping the apparatus with his hands, as is shown in FIG. 4, can ride on the surface of the water, dive underwater, swim underwater and come up for air voluntarily, with a minimal effort and without any more conditions, in principle, than those of a non-specialized swimmer-diver. As one gains experience and improves his skill, the possibilities are multiplied progressively, the limits being set by the sportsman's physical capacity and playfulness.

The structure is designed in accordance with all safety regulations, it being impossible for the same to injure the user, since it is always in front of him, the grips being designed ergonomically, for easy grip as well as for the loss of grip, freeing pressure from one's hands, there being no impediment at all that permits separation from the motorboat and its moving away at will. The profiles, curves and ends have smooth and rounded shapes, incapable of causing the minimal injury or scratches on the user's skin.

The material forming the apparatus will have the density required to ensure optimal floatability and submergibility, allowing the swimmer to rest while being supported and without requiring great effort in underwater swimming.

The underwater swimming can be done apnea with goggles and a snorkel, or with breathing with air tanks.

It permits several people to sail parallel, just like in water skiing with the required separation in the pulling points of the motorboat.

The speed of the motorboat and the length of the towing rope (5) are elements that will logically affect in a directly proportional manner the speed of riding on the water and the scope of possible maneuverability.

The scope of maneuverability is circumscribed in a semi-circle, base of a cone whose vertex is the traction point of the motorboat. The diameter of this semi-circle will be larger or smaller depending on two parameters, on the one hand the riding speed and on the other hand the length of the towing rope. The longer the line and the slower the speed, within the required minimum, the possible maneuverability diameter increases. Likewise, the maneuverability response will be a result of the riding speed; at maximum possible speeds the responses to the changes of direction will be rapid and spectacular, similar to maneuvers of dolphins.

The riding speed necessary is variable, varying between one and eight knots, which permits easy enjoyable riding and even acrobatics. Higher speeds will be possible for experienced skin divers, equipped with diving suits and goggles.

The length of the towing rope starts with a minimum of 24 meters for boats with a motor up to 25 HP. With more powerful motors the length will be progressively longer, 2 more meters for each HP increased.

The ease of riding on water and maneuverability, with the minimal effort makes it possible for this apparatus to have multiple uses, among which the following may be cited:

Gliding and slalom on the surface of water;

Observing the bottom of the sea, fauna and flora;

Recreational exercise;

Entertaining sports;

Competitive sports;

Locating sunken bodies and objects;

Locating wreckage or remains of shipwrecks;

Underwater photography;

Filming underwater movies;

Recreational devices at water installations or underwater amusement parks;

Underwater sightseeing at reefs or coral beds;

Recreation and competition on rapids;

Ski acrobatics and underwater acrobatics, sports and exhibition acrobatics;

It is not considered necessary to make this description any longer in order for any expert in the material to be able to understand the scope of the invention and the advantages that are derived from the same.

The materials, shape, size and arrangement of the elements are vulnerable to variation as long as they do not imply a change of the essence of the invention.

The terms in which this specification has been written should always be taken in a broad and non-restrictive sense.

What is claimed:

1. A towable board for underwater swimming and riding on the water surface comprising:

a substantially flat body having a front to rear axis, said body having a deep front notch and a rear notch dividing the body into two wings that are symmetric with respect to each other about said front to rear axis;

at least two gripping means for permitting gripping by a user's hands, said gripping means being disposed in each of said wings and being symmetric with respect to each other about said front to rear axis, said gripping means having a forward edge and a rear edge;

a traction point having means for being connected to a towing rope, said traction point being disposed on said front to rear axis, said traction point is disposed in a rear position with respect to a transverse line passing through a contact point of said user's hands on said gripping means, said contact point being disposed on said rear edge of said gripping means; and at least one fin being disposed on a bottom surface of the body.

2. A towable board according to claim 1, wherein said gripping means are windows.

3. A towable board according to claim 2, wherein the traction point is disposed in a transverse bridge-shaped piece that has at least two holes through which said piece is fastened to at least two holes disposed in said wings.

4. A towable board according to claim 3, wherein a position of the traction point can be adjusted along the front to rear axis.

5. A towable board according to claim 4, wherein a position of said piece is defined by a plurality of lines of consecutive holes in said piece that are disposed on both sides of said front to rear axis.

6. A towable board according to claim 3, wherein said piece has a plurality of consecutive holes by means of which said piece is coupled to at least two holes in said wings of the body.

7. A towable board according to claim 2, wherein said gripping means have ergonomical edges, and said at least one fin and said flat body each have a smooth and rounded shape without any sharp edges.

8. A towable board according to claim 1, wherein the traction point is a hole.

9. A towable board according to claim 1, wherein the traction point is located in a detachable piece.

10. A towable board according to claim 9, wherein said detachable piece is a transverse bridge-shaped piece and has at least two holes through which said piece is fastened to at least two holes disposed in said wings.

11. A towable board according to claim 10, wherein a position of said piece with respect to said wings are defined by a plurality of lines of consecutive holes disposed on both sides of said front to rear axis.

12. A towable board according to claim 10, wherein said piece has a plurality of consecutive holes by means of which said piece is coupled to at least two holes in said wings of the body.

13. A towable board according to claim 9, wherein a position of the traction point can be adjusted along the front to rear axis.

14. A towable board according to claim 13, wherein a position of said piece is defined by a plurality of lines of consecutive holes in said piece that are disposed on both sides of said front to rear axis.

15. A towable board according to claim 1, wherein a position of the traction point can be adjusted along the front to rear axis.

16. A towable board according to claim 15, wherein said adjustable position is defined by lines of a plurality of consecutive holes disposed on both sides of said from to rear axis.

17. A towable board according to claim 15, wherein said adjustable position is defined by a plurality of consecutive holes disposed in a detachable piece by means of which said piece is coupled to at least two holes in said wings of the body.

18. A towable board according to claim 17, wherein said gripping means have ergonomical edges and said at least one fin and said flat body each have a smooth and rounded shape without any sharp edges.

19. A towable board according to claim 1, wherein the traction point is disposed in a transverse bridge-shaped piece that has at least two holes through which said piece is fastened to at least two holes disposed in said wings.

20. A towable board according to claim 19, wherein a position of the traction point can be adjusted along the front to rear axis.

21. A towable board according to claim 20, wherein a position of said piece is defined by a plurality of lines of consecutive holes in said piece that are disposed on both sides of said front to rear axis.

22. A towable board according to claim 19, wherein said piece has a plurality of consecutive holes by means of which said piece is coupled to at least two holes in said wings of the body.

23. A towable board according to claim 1, wherein said gripping means have ergonomical edges and said at least one fin and said flat body each have a smooth and rounded shape without any sharp edges.

24. A towable board for underwater swimming and riding on the water surface comprising:

a substantially flat body having a front to rear axis, said body having a deep front notch and a rear notch dividing the body into two wings that are symmetric with respect to each other about said front to rear axis;

at least two gripping means for permitting gripping by a user's hands, said gripping means being disposed in each of said wings and being symmetric with respect to each other about said front to rear axis;

a traction point having means for being connected to a towing rope, said traction point being disposed on said front to rear axis, wherein said front notch has a saddle point that is located in a rear position with respect to a transverse line passing through said gripping means, and the traction point is located between said saddle-point and said transverse line; and at least one fin placed on a bottom surface of the body.

* * * * *